US011612032B2

(12) United States Patent
Wu et al.

(10) Patent No.: US 11,612,032 B2
(45) Date of Patent: Mar. 21, 2023

(54) LED DEVICE WITH LATERAL LIGHT EMISSION

(71) Applicant: ZHANGZHOU GO WIN LIGHTING CO., LTD, Zhangzhou (CN)

(72) Inventors: Qingan Wu, Zhangzhou (CN); Xiongzhong Lin, Zhangzhou (CN); Yaying Huang, Zhangzhou (CN)

(73) Assignee: ZHANGZHOU GO WIN LIGHTING CO., LTD, Zhangzhou (CN)

( * ) Notice: Subject to any disclaimer, the term of this patent is extended or adjusted under 35 U.S.C. 154(b) by 0 days.

(21) Appl. No.: 17/681,847

(22) Filed: Feb. 28, 2022

(65) Prior Publication Data

US 2022/0295617 A1 Sep. 15, 2022

(30) Foreign Application Priority Data

Mar. 11, 2021 (CN) ..... 202120512505.1

(51) Int. Cl.
*H05B 45/37* (2020.01)

(52) U.S. Cl.
CPC ..... *H05B 45/37* (2020.01)

(58) Field of Classification Search
None
See application file for complete search history.

(56) References Cited

U.S. PATENT DOCUMENTS

2010/0277067 A1* 11/2010 Maxik ..... F21V 3/00 315/32
2015/0257211 A1* 9/2015 Johnson ..... F21K 9/00 315/121
2016/0165680 A1* 6/2016 Johnson ..... F21V 23/005 438/23
2019/0297706 A1* 9/2019 Huang ..... H05B 45/375

* cited by examiner

*Primary Examiner* — Anh Q Tran

(57) ABSTRACT

An LED device with lateral light emission includes a circuit board, a rectifying circuit, and an LED light source. The rectifying circuit includes a positive lead, a negative lead, a rectifier, a first resistor, and a second resistor, the positive lead and negative lead are provided on an end of the circuit board, the rectifier is provided on a first surface of the circuit board, and the first resistor and second resistor are provided on a second surface of the circuit board. The LED light source is provided on a side surface of the circuit board. By configuring the LED light source on the side surface of the circuit board through via holes, the layout of the electronic components is more compact and flexible, and adaptable to more light distribution designs.

18 Claims, 9 Drawing Sheets

LED DEVICE WITH LATERAL LIGHT EMISSION

CROSS-REFERENCE TO RELATED APPLICATIONS

This application is based upon and claims priority to Chinese Patent Application No. 202120512505.1, filed on Mar. 11, 2021, the entire content of which is incorporated herein by reference.

TECHNICAL FIELD

The present disclosure generally relates to optoelectronic technology, in particular to an LED device with lateral light emission.

BACKGROUND

LED lighting market is an emerging market that benefited from the development of society, and its application field is constantly expanding which puts forward higher requirements for the performance of LED light sources. LED lights have many advantages, such as being environmental friendly, energy saving, compact, have a long service life, etc. It is a foreseeable trend that LED lights will gradually replace traditional fluorescent lamps and incandescent lamps in the general lighting field in the future. However, in practice, the service life of LED lamps is susceptible to many factors including temperature, device aging, etc. The overall volume of an LED device consists of the volume of the LED light and the volume of the driving circuit, which is bulky in some circumstances. Moreover, the LED light of current LED devices is usually arranged on an upper surface, which limits the layout of other electronic components on the PCB board, and cannot satisfy various light distribution designs. Therefore, there is an urgent need to improve the existing LED lamps to increase their service life and reduce their overall volume.

SUMMARY

In view of the drawbacks of the prior art, it is an object of the present disclosure to provide an LED device with lateral light emission which is simple in structure, compact, has long service life, and is adaptable to various light distribution designs.

According to an aspect of the present disclosure, an LED device with lateral light emission is provided, which includes a circuit board, a rectifying circuit, and an LED light source. The rectifying circuit comprises a positive lead, a negative lead, a rectifier, a first resistor, and a second resistor. The positive lead and negative lead are provided on an end of the circuit board, the rectifier is provided on a first surface of the circuit board, and the first resistor and second resistor are provided on a second surface of the circuit board. The LED light source is provided on a side surface of the circuit board. The positive lead is connected to a first end of the first resistor, a second end of the first resistor is connected to a first terminal of the rectifier, a second terminal of the rectifier is connected to a first end of the second resistor, a second end of the second resistor is connected to a positive electrode of the LED light source, a negative electrode of the LED light source is connected to a fourth terminal of the rectifier, and a third terminal of the rectifier is connected to the output lead.

Furthermore, the LED light source includes an LED chip, the LED chip is configured on the side surface of the circuit board through via holes provided on the side surface.

According to another aspect of the present disclosure, an LED device with lateral light emission is provided, which includes: a circuit board, electronic components, and an LED light source. The circuit board includes a substrate, a top conductive layer, a bottom conductive layer, and power source leads, the top conductive layer and bottom conductive layer are respectively provided on an upper side and a bottom side of the substrate and each include a conductive pattern that connects the electronic components thereon, the power source leads are connected to the top conductive layer or the bottom conductive layer. The electronic components respectively arranged on the upper side and the bottom side of the substrate are electrically connected by conductive holes provided on the substrate. The conductive holes include via holes located on a side surface of the substrate, each via hole has a side opening, and a sidewall of each via hole is coated with a conductive layer. The LED light source includes a light-emitting surface and pins located on an opposite side of the light-emitting surface, the pins pass through the side openings of the via holes to be electrically connected with the conductive layers on the sidewalls of the via holes.

Furthermore, the conductive layer is coated on the sidewall of each via hole by electroless plating, and the pins of the LED light source are electrically connected with the conductive layers via a solder.

Furthermore, the electronic components include a bridge rectifier, a first resistor, and a second resistor. The bridge rectifier includes a first terminal, a second terminal, a third terminal, and a fourth terminal. The power source leads include a positive lead and a negative lead. The positive lead is connected to a first end of the first resistor, a second end of the first resistor is connected to the first terminal, the second terminal is connected to a first end of the second resistor, a second end of the second resistor is connected to a positive electrode of the LED light source, a negative electrode of the LED light source is connected to the fourth terminal, and the third terminal is connected to the negative lead.

Furthermore, the LED light source is a monochrome LED chip.

Furthermore, the LED light source is a RGB LED chip, the substrate further includes a middle layer located between the top conductive layer and the bottom conductive layer, the conductive holes further include one or more buried via holes provided on the the middle layer, and the via holes are only provided on the side surfaces of the top conductive layer and the bottom conductive layer.

Furthermore, the electronic components further include a micro-controller unit, the micro-controller unit includes a plurality of input pins, a VDD pin, and a VSS pin. The RGB LED chip includes three LED lamps, the positive electrodes of the three LED lamps are respectively connected to the second end of the second resistor. The first resistor is connected with a first capacitor in parallel, the second end of the second resistor and the fourth terminal are respectively connected with a second capacitor and a voltage-regulator diode in parallel. The negative electrodes of the three LED lamps are respectively connected to the input pins, the VDD pin is connected to the second end of the second resistor, and the VSS pin is connected to the fourth terminal and grounded.

Furthermore, the LED light source is a RGBW LED chip, the substrate further includes a first middle layer, a second middle layer, and a third middle layer sequentially located between the top conductive layer and the bottom conductive layer. The conductive holes further include one or more buried via holes provided on the first middle layer and third middle layer, and the via holes are only provided on the side surfaces of the top conductive layer, the bottom conductive layer, and the second middle layer.

Furthermore, the electronic components further include a micro-controller unit, the micro-controller unit comprises a plurality of input pins, a VDD pin, and a VSS pin. The RGBW LED chip includes four LED lamps, the positive electrodes of the four LED lamps are respectively connected to the second end of the second resistor. The first resistor is connected with a first capacitor in parallel, the second end of the second resistor and the fourth terminal are respectively connected with a second capacitor and a voltage-regulator diode in parallel. The negative electrodes of the four LED lamps are respectively connected to the input pins, the VDD pin is connected to the second end of the second resistor, and the VSS pin is connected to the fourth terminal and grounded.

According to yet another aspect of the present disclosure, an LED device with lateral light emission is provided, which includes: a circuit board, electronic components, and an LED light source. The circuit board includes a substrate, a top conductive layer, a bottom conductive layer, and power source leads. The substrate has multiple surfaces including a top surface, a bottom surface, and a plurality of side surfaces, the top conductive layer and bottom conductive layer are respectively provided on the upper side and the bottom side of the substrate and each include a conductive pattern that connects the electronic components thereon, the power source leads are connected to the top conductive layer or the bottom conductive layer. The electronic components respectively arranged on the upper side and the bottom side of the substrate are electrically connected by conductive holes provided on the substrate. The LED light source includes a plurality of LED chips respectively provided on one or more of the multiple surfaces of the substrate. The conductive holes include a plurality of via holes correspondingly located on the side surfaces of the substrate provided with the LED chips, each via hole has a side opening, and a sidewall of each via hole is coated with a conductive layer. The LED chips each include a light-emitting surface and pins located on an opposite side of the light-emitting surface, the pins of the LED chip(s) located on the side surface(s) of the substrate pass(es) through the side openings of the via holes to be electrically connected with the conductive layers on the sidewalls of the via holes.

Furthermore, the conductive layer is coated on the sidewall of each via hole by electroless plating, and the pins of the LED chip(s) are electrically connected with the conductive layers via a solder.

Furthermore, the electronic components include a bridge rectifier, a first resistor, and a second resistor. The bridge rectifier comprises a first terminal, a second terminal, a third terminal, and a fourth terminal. The power source leads include a positive lead and a negative lead. The positive lead is connected to a first end of the first resistor, a second end of the first resistor is connected to the first terminal, the second terminal is connected to a first end of the second resistor, a second end of the second resistor is connected to a positive electrode of the LED light source, a negative electrode of the LED light source is connected to the fourth terminal, and the third terminal is connected to the negative lead.

Furthermore, the LED light source is a monochrome LED chip.

Furthermore, the LED chips are RGB LED chips, the substrate further includes a middle layer located between the top conductive layer and the bottom conductive layer, the conductive holes further include one or more buried via holes provided on the the middle layer, and the via holes are only provided on the side surfaces of the top conductive layer and the bottom conductive layer.

Furthermore, the electronic components further include a micro-controller unit, the micro-controller unit includes a plurality of input pins, a VDD pin, and a VSS pin. The RGB LED chips are connected in parallel, and each RGB LED chip includes three LED lamps, the positive electrodes of the three LED lamps are respectively connected to the second end of the second resistor. The first resistor is connected with a first capacitor in parallel, the second end of the second resistor and the fourth terminal are respectively connected with a second capacitor and a voltage-regulator diode in parallel. The negative electrodes of the three LED lamps are respectively connected to the input pins, the VDD pin is connected to the second end of the second resistor, and the VSS pin is connected to the fourth terminal and grounded.

Furthermore, the LED chips are RGBW LED chips, the substrate further includes a first middle layer, a second middle layer, and a third middle layer sequentially located between the top conductive layer and the bottom conductive layer. The conductive holes further include one or more buried via holes provided on the first middle layer and third middle layer, and the via holes are only provided on the side surfaces of the top conductive layer, the bottom conductive layer, and the second middle layer.

Furthermore, the electronic components further include a micro-controller unit, the micro-controller unit comprises a plurality of input pins, a VDD pin, and a VSS pin. The RGBW LED chips are connected in parallel, and each RGBW LED chip includes four LED lamps, the positive electrodes of the four LED lamps are respectively connected to the second end of the second resistor. The first resistor is connected with a first capacitor in parallel, the second end of the second resistor and the fourth terminal are respectively connected with a second capacitor and a voltage-regulator diode in parallel. The negative electrodes of the four LED lamps are respectively connected to the input pins, the VDD pin is connected to the second end of the second resistor, and the VSS pin is connected to the fourth terminal and grounded.

The present disclosure at least has the following advantages: by configuring the LED light source on the side surface of the circuit board through via holes, the layout of the electronic components is more compact and flexible, and adaptable to more light distribution designs. The pins of the LED light source are connected to the conductive layer coated on the sidewall of the via hole and acting as the bond pads. Normally, the via hole of a double or multiple layer PCB is used to electrically connect different layers of the board, and the LED is connected to the PCB by bond pads on the top or bottom layer. Compared with the traditional structure, the conductive layer on the sidewall of the via hole of the present disclosure has a larger area and higher peel strength, thereby improving the electrical conductivity, the firmness of the connection between the LED light source and the PCB, the heat dissipation performance of the pins of the LED light source, the stability of LED performance, expandability, LED product yield and saving the cost.

DETAILED DESCRIPTION OF THE DRAWINGS

In order to clearly explain the embodiments of the present disclosure, the drawings that would be used in describing the embodiments will briefly introduced below. It should be understood that the drawings illustrated below merely includes some of the embodiments of the present disclosure and should not be considered as limiting the scope of the present disclosure. For those of ordinary skill in the art, other drawings may be derived based on these drawings without creative effort.

DETAILED DESCRIPTION OF THE EMBODIMENTS

Figure 1:
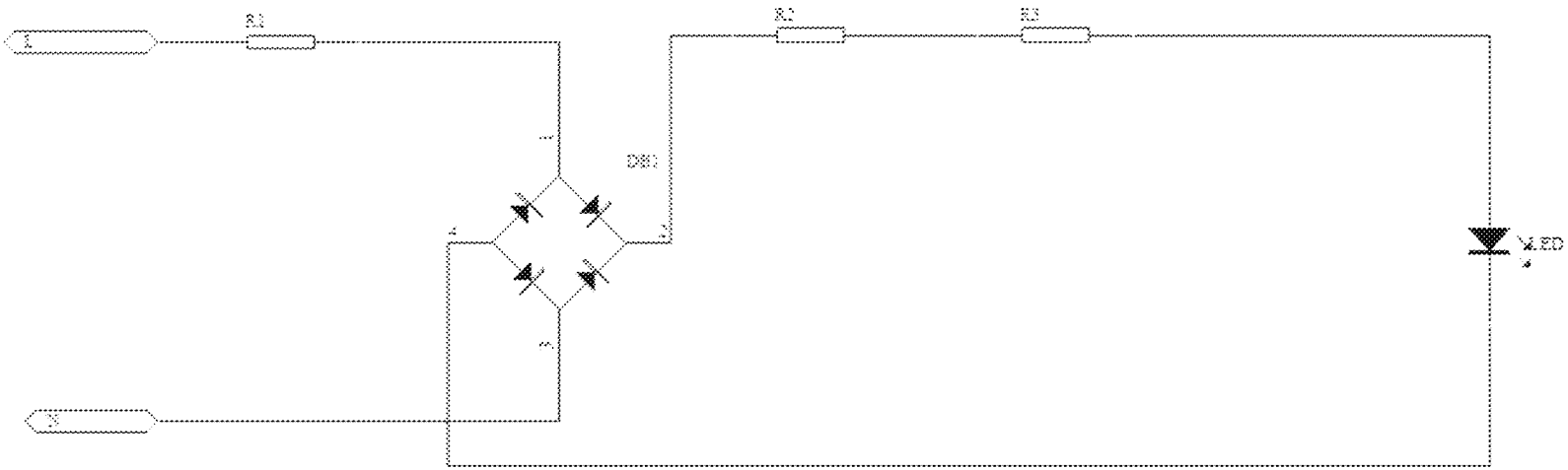
FIG. 1 is a schematic circuit diagram of an LED device with lateral light emission according to an embodiment of the present disclosure.

In order to make the objectives, technical solutions, and advantages of the embodiments of the present disclosure clearer, the technical solutions of the embodiments of the present disclosure will be described clearly and completely below with reference to the drawings of the embodiments of the present disclosure. Obviously, the described embodiments are parts of, but not all of, the embodiments of the present disclosure. Based on the embodiments of the present disclosure, all other embodiments derived by those of ordinary skills in the art without creative effort fall within the scope of protection of the present disclosure. Accordingly, the following detailed description of the embodiments of the present disclosure shown in the drawings is not intended to limit the scope of protection of the present disclosure, but merely to represent selected embodiments of the present disclosure. Based on the embodiments of the present disclosure, all other embodiments derived by those of ordinary skills in the art without creative effort fall within the scope of protection of the present disclosure.

In the description of the present disclosure, the terms "first", "second" are used only for descriptive purposes and cannot be understood as indicating or implying relative imterminalance or implying the number of indicated technical features. Thus, a characteristic that is referred to by "first" and "second" may include, expressly or implicitly, one or more of the characteristics. Also, it should be noted that the terms of "up", "bottom", "inside/inner", "outside/outer", "front end", "rear end", "two ends", "one end", "another end", "one side", "another side" for indicating the location or orientation are based on the location or orientation shown in the drawings for the sake of simplifying the description of the present disclosure, rather than indicate or imply that the indicated device or component must have specific location or orientation, or be constructed and operated by specific orientation. These terms should not be understood as limits to the present disclosure.

In the description of the present disclosure, it should be noted that, unless otherwise clearly defined, the terms "provide/arrange", "connect", etc. should be understood in a broad sense. For example, "connect" may be interpreted as a fixed connection, a detachable connection, or an integrated connection, it may also be interpreted as a mechanical connection or an electrical connection, or a direct connection or an indirect connection through an intermediate medium. Optionally, it may refer to the communication of two components. For those of ordinary skill in the art, the meaning of the above-mentioned terms in the present disclosure should be understood under specific circumstances.

The content of the present disclosure will be described in detail below in terms of the embodiments.

Embodiment 1

Figure 2:
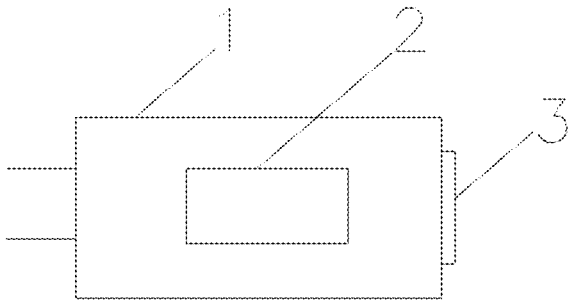
FIG. 2 is a structural schematic diagram showing a top surface of the LED device with lateral light emission according to an embodiment of the present disclosure.
Figure 3:
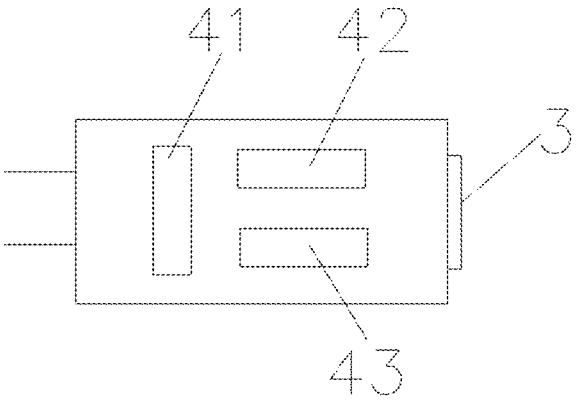
FIG. 3 is a structural schematic diagram showing a bottom surface of the LED device with lateral light emission according to an embodiment of the present disclosure.
Figure 4:
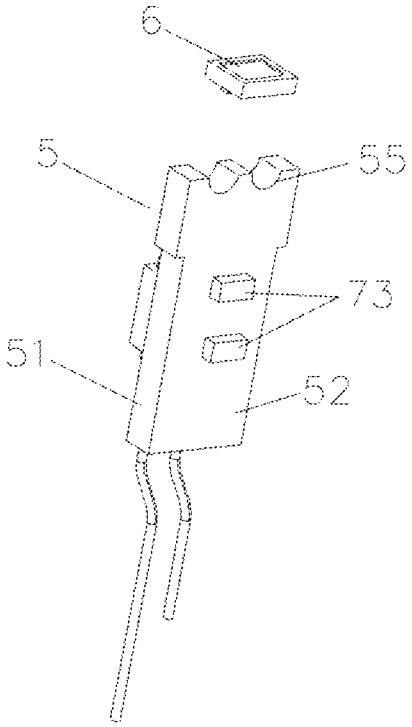
FIG. 4 is a structural schematic diagram showing a perspective view of the LED device with lateral light emission according to an embodiment of the present disclosure.
Figure 5:
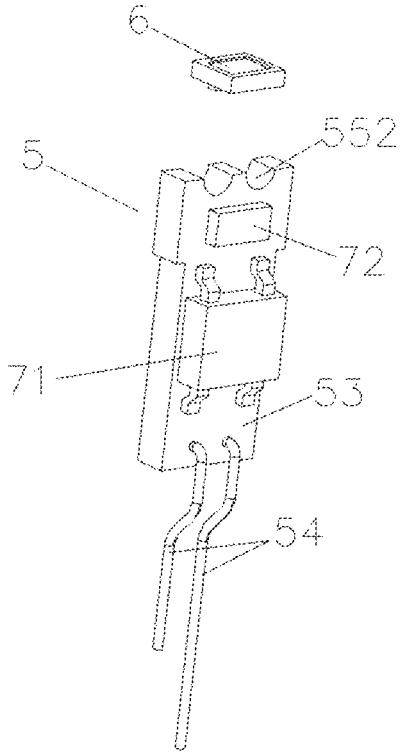
FIG. 5 is a structural schematic diagram showing a perspective view from another angle of an LED device with lateral light emission according to an embodiment of the present disclosure.
Figure 6:
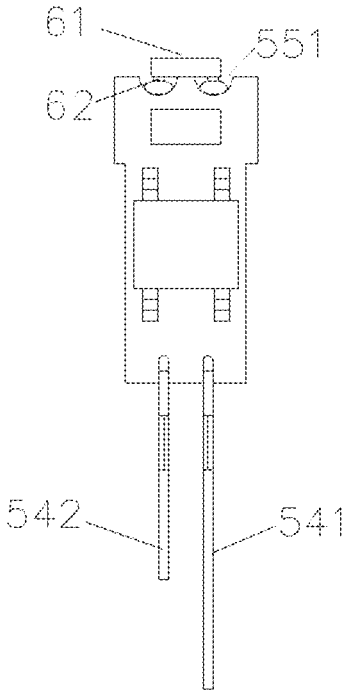
FIG. 6 is a structural schematic diagram showing a bottom surface of the LED device with lateral light emission according to an embodiment of the present disclosure.
Figure 7:
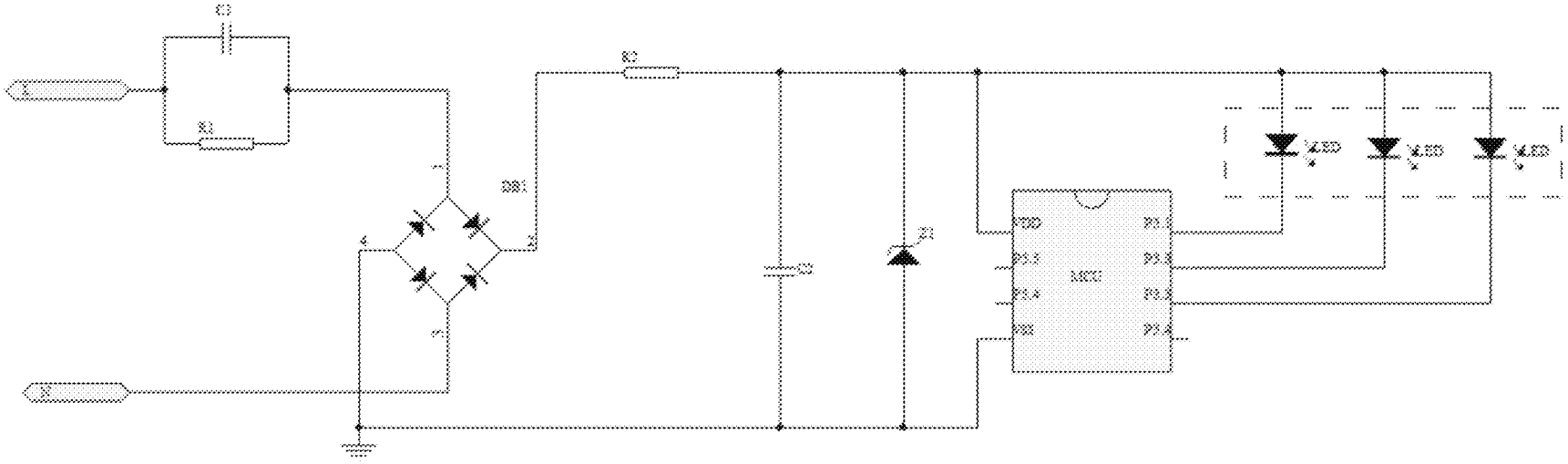
FIG. 7 is a schematic circuit diagram of an LED device with lateral light emission according to an embodiment of the present disclosure.
Figure 8:
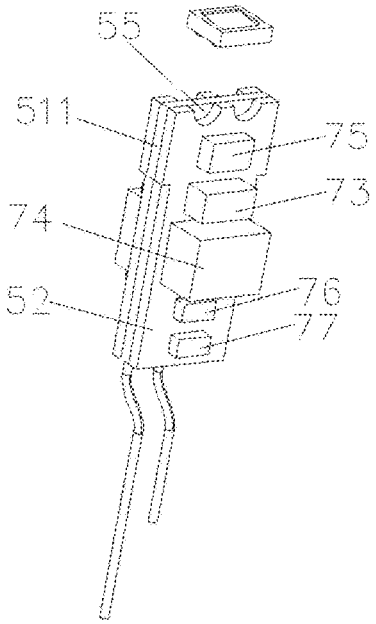
FIG. 8 is a structural schematic diagram showing a perspective view of the LED device with lateral light emission according to an embodiment of the present disclosure.
Figure 9:
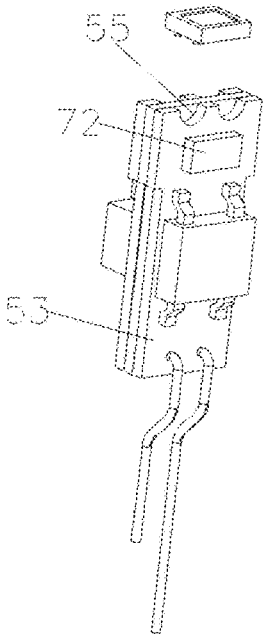
FIG. 9 is a structural schematic diagram showing a perspective view from another angle of an LED device with lateral light emission according to an embodiment of the present disclosure.
Figure 10:
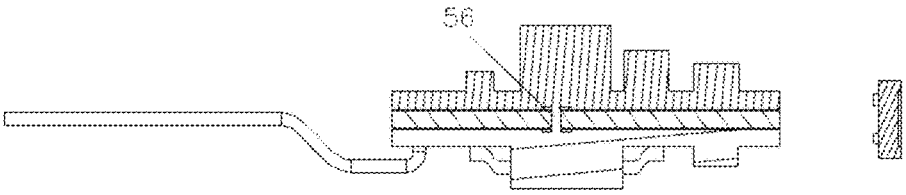
FIG. 10 is a cross-sectional view of the LED device with lateral light emission shown in FIG. 9.
Figure 11:
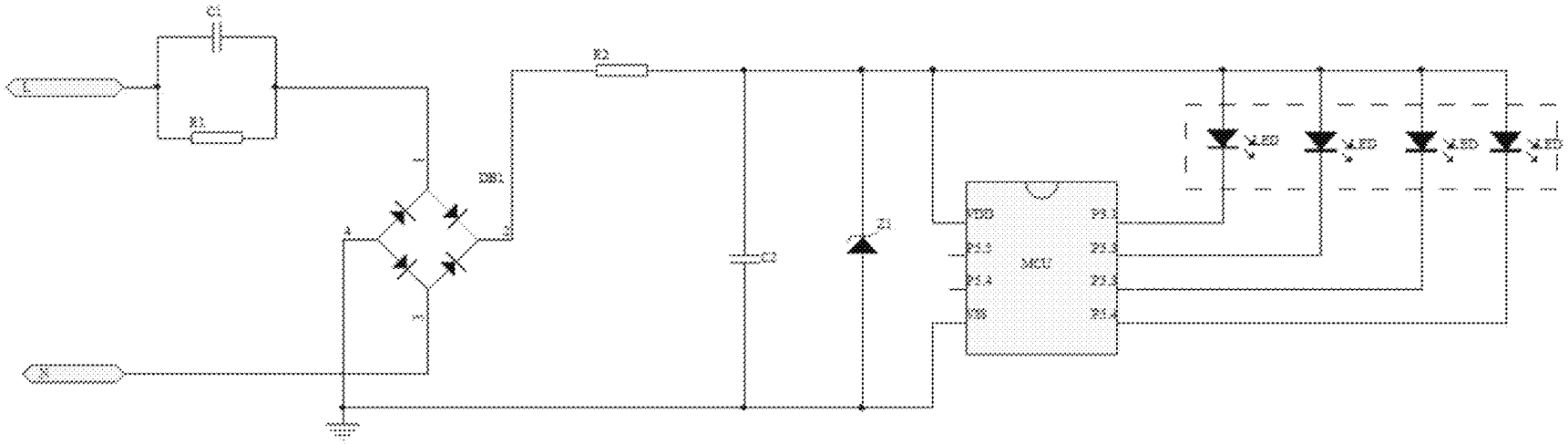
FIG. 11 is a schematic circuit diagram of an LED device with lateral light emission according to an embodiment of the present disclosure.
Figure 12:
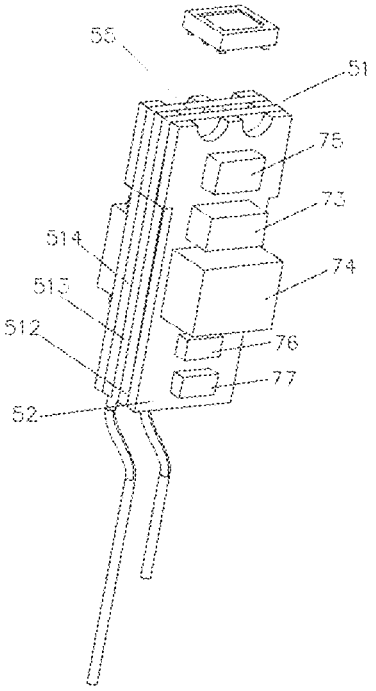
FIG. 12 is a structural schematic diagram showing a perspective view of the LED device with lateral light emission according to an embodiment of the present disclosure.
Figure 13:
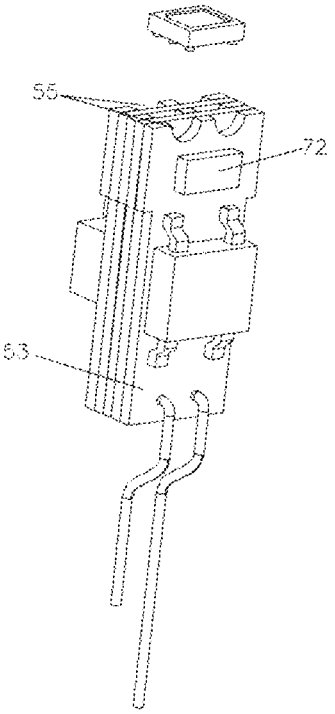
FIG. 13 is a structural schematic diagram showing a perspective view from another angle of an LED device with lateral light emission according to an embodiment of the present disclosure.
Figure 14:
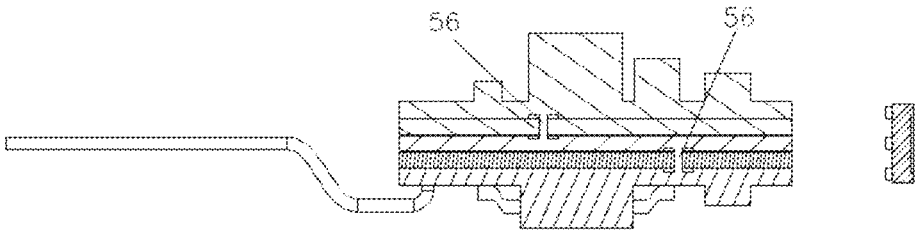
FIG. 14 is a cross-sectional view of the LED device with lateral light emission shown in FIG. 13.

According to FIGS. 1-3, the present disclosure provides an LED device with lateral light emission which includes a circuit board 1, a rectifying circuit, and an LED light source 3. The rectifying circuit includes a positive lead, a negative lead, a rectifier 2, a first resistor 41, and a second resistor 42 and 43. The positive lead and negative lead are provided on an end of the circuit board 1, the rectifier 2 is provided on a top surface of the circuit board 1, and the first resistor 41 and second resistor 42 and 43 are provided on a bottom surface of the circuit board 1. The LED light source 3 is provided on a side surface of the circuit board 1. The positive lead is connected to a first end of the first resistor 41, a second end of the first resistor 41 is connected to a first terminal of the rectifier 2, a second terminal of the rectifier 2 is connected to a first end of the second resistor 42 and 43, a second end of the second resistor 42 and 43 is connected to a positive electrode of the LED light source 3, a negative electrode of the LED light source 3 is connected to a fourth terminal of the rectifier 2, and a third terminal of the rectifier 2 is connected to the output lead.

Furthermore, the LED light source 3 is an LED chip, the LED chip is configured on the side surface of the circuit board through via holes provided on the side surface.

Furthermore, the resistance of the first resistor 41 may be 0.1-5 kΩ. The second resistor may include two resistors having the same resistance and connected in series, and the resistance may be 1-10 kΩ. According to a specific implementation, the resistance of the first resistor 41 may be 1 kΩ, the resistance of the second resistor 42 or 43 may 6.8 kΩ.

Furthermore, the rectifier 2 may be a MB6S rectifier. It should be noted that the resistance of the first resistor and the second resistor may be adjusted according to the parameters of the bridge rectifier and LED chip.

The LED device with lateral light emission of the present embodiment may achieve the side illumination effects. Compared with the traditional LED device having the LED light mounted on the top or bottom surface of the circuit board, the structure of the present disclosure may achieve a better heat dissipation effect, smaller occupation space, longer service life, and lower cost.

Embodiment 2

As shown in FIGS. 1 and 4-14, the present embodiment provides an LED device with lateral light emission which includes: a circuit board 5, electronic components, and an LED light source 6. The circuit board 5 includes a substrate 51, a top conductive layer 52, a bottom conductive layer 53, and power source leads 54. The top conductive layer 52 and bottom conductive layer 53 are respectively provided on an upper side and a bottom side of the substrate 51 and each include a conductive pattern that connects the electronic components thereon, the power source leads 54 are connected to the top conductive layer 52 or the bottom conductive layer 53. The electronic components respectively arranged on the upper side and the bottom side of the substrate 51 are electrically connected by conductive holes provided on the substrate 51. The conductive holes include via holes 55 located on a side surface of the substrate 51, each via hole 55 has a side opening 551, and a sidewall of each via hole 55 is coated with a conductive layer 552. The LED light source 6 includes a light-emitting surface 61 and pins 62 located on an opposite side of the light-emitting surface 61, the pins 62 pass through the side openings 551 of the via holes 55 to be electrically connected with the conductive layers 552 on the sidewalls of the via holes 55. The via holes 55 may have a semi-circular shape or semi-rectangular shape, or a semi-square shape etc. The conductive layer 552 may be fully or partially coated on the sidewall of the via holes 55. The material of the conductive layer 552 may be copper or other conductive metals.

Furthermore, the conductive layer 552 is coated on the sidewall of each via hole 55 by electroless plating, and the pins 62 of the LED light source 6 are electrically connected with the conductive layers 552 via a solder. The solder may be soldering tin or other suitable materials.

Furthermore, the electronic components include a bridge rectifier 71, a first resistor 72, and a second resistor 73. The bridge rectifier 71 includes a first terminal, a second terminal, a third terminal, and a fourth terminal. The power source leads 54 include a positive lead 541 and a negative lead 542. The positive lead 541 is connected to a first end of the first resistor 72, a second end of the first resistor 72 is connected to the first terminal, the second terminal is connected to a first end of the second resistor 73, a second end of the second resistor 73 is connected to a positive electrode of the LED light source 6, a negative electrode of the LED light source 6 is connected to the fourth terminal, and the third terminal is connected to the negative lead 542.

Optionally, the LED light source may be a monochrome LED chip.

Optionally, the LED light source 6 may be a RGB LED chip, the substrate 51 further includes a middle layer 511 located between the top conductive layer 52 and the bottom conductive layer 53, the conductive holes further include one or more buried via holes 56 provided on the the middle layer 511, and the via holes 55 are only provided on the side surfaces of the top conductive layer 52 and the bottom conductive layer 53. The electronic components further include a micro-controller unit 74, the micro-controller unit 74 includes a plurality of input pins, a VDD pin, and a VSS pin. The RGB LED chip includes three LED lamps, the positive electrodes of the three LED lamps are respectively connected to the second end of the second resistor 73. The first resistor 72 is connected with a first capacitor 75 in parallel, the second end of the second resistor 73 and the fourth terminal are respectively connected with a second capacitor 76 and a voltage-regulator diode 77 in parallel. The negative electrodes of the three LED lamps are respectively connected to the input pins, the VDD pin is connected to the second end of the second resistor 73, and the VSS pin is connected to the fourth terminal and grounded.

Optionally, the LED light source 6 may be a RGBW LED chip, the substrate 51 further includes a first middle layer 512, a second middle layer 513, and a third middle layer 514 sequentially located between the top conductive layer 52 and the bottom conductive layer 53. The conductive holes further include one or more buried via holes 56 provided on the first middle layer 512 and third middle layer 514, and the via holes 55 are only provided on the side surfaces of the top conductive layer 52, the bottom conductive layer 53, and the second middle layer 513. The electronic components further include a micro-controller unit 74, the micro-controller unit 74 includes a plurality of input pins, a VDD pin, and a VSS pin. The RGBW LED chip includes four LED lamps, the positive electrodes of the four LED lamps are respectively connected to the second end of the second resistor 73. The first resistor 72 is connected with a first capacitor 75 in parallel, the second end of the second resistor 73 and the fourth terminal are respectively connected with a second capacitor 76 and a voltage-regulator diode 77 in parallel. The negative electrodes of the four LED lamps are respectively connected to the input pins, the VDD pin is connected to the second end of the second resistor 73, and the VSS pin is connected to the fourth terminal and grounded.

According to the present embodiment, an exemplary implementation shows that an LED device with lateral light emission is provided with one LED chip, and the LED chip may be a monochrome LED chip, a RGB LED chip, a RGBW LED chip or other LED chips. Accordingly, the circuit board and the position of the via holes for mounting the LED chip are designed in terms of different types of LED chip. By configuring the LED chip on the side surface of the circuit board through via holes, the layout of the electronic components is more compact and flexible, and adaptable to more light distribution designs. The pins of the LED chip are connected to the conductive layer coated on the sidewall of the via hole and acting as the bond pads, thereby improving the electrical conductivity, the firmness of the connection between the LED chip and the circuit board, the heat dissipation performance of the pins of the LED chip, the stability of LED performance, expandability, LED product yield and saving the cost.

Embodiment 3

Based on embodiment 2, in present embodiment, the LED device with lateral light emission may have multiple LED chips respectively configured on one or more sides of the substrate, including a top side, a bottom side, and a plurality of lateral sides, for example, four lateral sides. The multiple LED chips may be configured on some of the lateral sides, or both on the top or bottom side and the lateral side, or all of the six sides.

Figure 15:
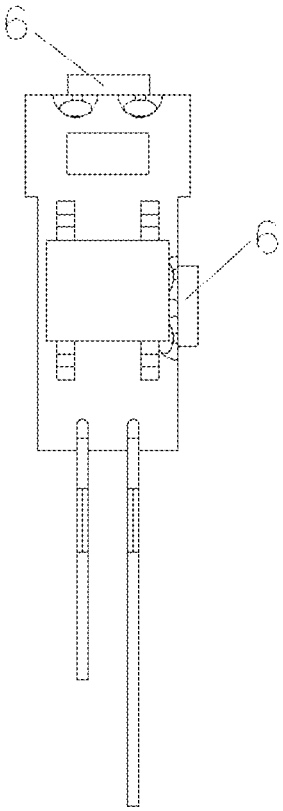
FIG. 15 is a structural schematic diagram showing a bottom surface of the LED device with lateral light emission according to an embodiment of the present disclosure.
Figure 16:
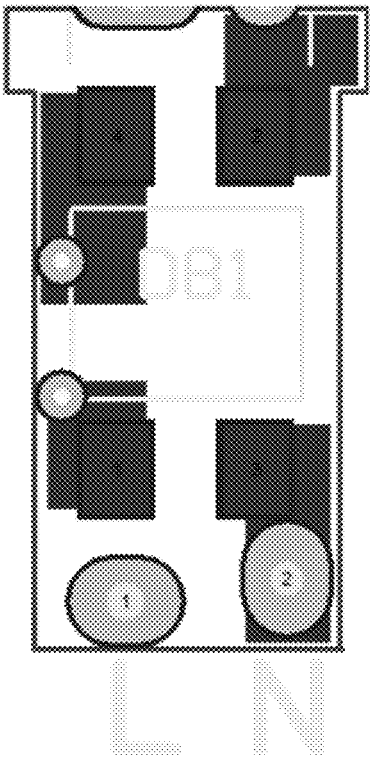
FIGS. 16-17 show an exemplary layout of the circuit shown in FIG. 1.
Figure 17:
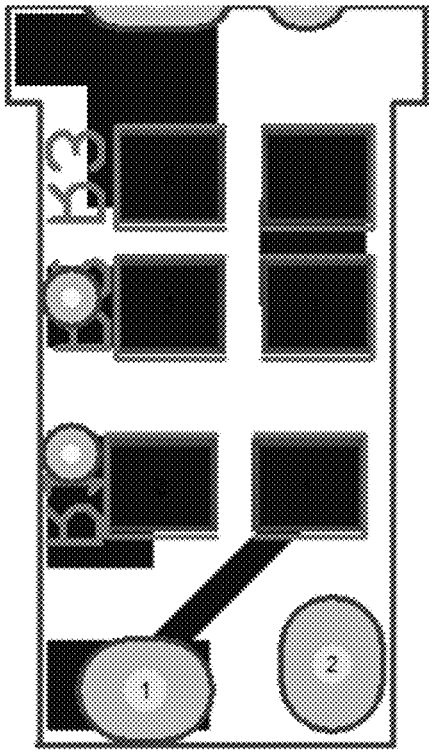

In an exemplary implementation, as shown in FIG. 15, two LED chips are respectively provided on two lateral sides of the substrate. It should be noted that other configurations may also be derived based on the disclosure above, and these configurations should be considered as falling within the scope of the present disclosure.

In the present embodiment, the LED device with lateral light emission of the present disclosure is adaptable to a wide range of light distribution designs, and may achieve a lateral and/or three-dimensional illumination effect.

The implementations in the above embodiments may be further combined or replaced, and the embodiments merely describe the preferred embodiments of the present disclosure, without limiting the concept and scope of the present disclosure. All the changes and improvements made by those of ordinary skill in the art to the technical solution of the present disclosure without departing from the design concept of the present disclosure fall within the protection scope of the present disclosure.

What is claimed is:

1. An LED device with lateral light emission, comprising a circuit board, a rectifying circuit, and an LED light source, wherein the rectifying circuit comprises a positive lead, a negative lead, a rectifier, a first resistor, and a second resistor, the positive lead and negative lead are provided on an end of the circuit board, the rectifier is provided on a first surface of the circuit board, and the first resistor and second resistor are provided on a second surface of the circuit board;

the LED light source is provided on a side surface of the circuit board;

the positive lead is connected to a first end of the first resistor, a second end of the first resistor is connected to a first terminal of the rectifier, a second terminal of the rectifier is connected to a first end of the second resistor, a second end of the second resistor is connected to a positive electrode of the LED light source, a negative electrode of the LED light source is connected to a fourth terminal of the rectifier, and a third terminal of the rectifier is connected to the output lead.

2. The LED device with lateral light emission according to claim 1, wherein the LED light source comprises an LED chip, the LED chip is configured on the side surface of the circuit board through via holes provided on the side surface.

3. An LED device with lateral light emission, comprising: a circuit board, electronic components, and an LED light source, wherein the circuit board comprises a substrate, a top conductive layer, a bottom conductive layer, and power source leads, the top conductive layer and bottom conductive layer are respectively provided on an upper side and a bottom side of the substrate and each include a conductive pattern that connects the electronic components thereon, the power source leads are connected to the top conductive layer or the bottom conductive layer;

the electronic components respectively arranged on the upper side and the bottom side of the substrate are electrically connected by conductive holes provided on the substrate;

the conductive holes include via holes located on a side surface of the substrate, each via hole has a side opening, and a sidewall of each via hole is coated with a conductive layer; and the LED light source includes a light-emitting surface and pins located on an opposite side of the light-emitting surface, the pins pass through the side openings of the via holes to be electrically connected with the conductive layers on the sidewalls of the via holes.

4. The LED device with lateral light emission according to claim 3, wherein the conductive layer is coated on the sidewall of each via hole by electroless plating, and the pins of the LED light source are electrically connected with the conductive layers via a solder.

5. The LED device with lateral light emission according to claim 4, wherein the electronic components comprise a bridge rectifier, a first resistor, and a second resistor;

the bridge rectifier comprises a first terminal, a second terminal, a third terminal, and a fourth terminal;

the power source leads comprise a positive lead and a negative lead;

the positive lead is connected to a first end of the first resistor, a second end of the first resistor is connected to the first terminal, the second terminal is connected to a first end of the second resistor, a second end of the second resistor is connected to a positive electrode of the LED light source, a negative electrode of the LED light source is connected to the fourth terminal, and the third terminal is connected to the negative lead.

6. The LED device with lateral light emission according to claim 5, wherein the LED light source is a monochrome LED chip.

7. The LED device with lateral light emission according to claim 5, wherein the LED light source is a RGB LED chip, the substrate further comprises a middle layer located between the top conductive layer and the bottom conductive layer, the conductive holes further include one or more buried via holes provided on the the middle layer, and the via holes are only provided on the side surfaces of the top conductive layer and the bottom conductive layer.

8. The LED device with lateral light emission according to claim 7, wherein the electronic components further comprise a micro-controller unit, the micro-controller unit comprises a plurality of input pins, a VDD pin, and a VSS pin;

the RGB LED chip comprises three LED lamps, the positive electrodes of the three LED lamps are respectively connected to the second end of the second resistor;

the first resistor is connected with a first capacitor in parallel, the second end of the second resistor and the fourth terminal are respectively connected with a second capacitor and a voltage-regulator diode in parallel;

the negative electrodes of the three LED lamps are respectively connected to the input pins, the VDD pin is connected to the second end of the second resistor, and the VSS pin is connected to the fourth terminal and grounded.

9. The LED device with lateral light emission according to claim 5, wherein the LED light source is a RGBW LED chip, the substrate further comprises a first middle layer, a second middle layer, and a third middle layer sequentially located between the top conductive layer and the bottom conductive layer, the conductive holes further include one or more buried via holes provided on the first middle layer and third middle layer, and the via holes are only provided on the side surfaces of the top conductive layer, the bottom conductive layer, and the second middle layer.

10. The LED device with lateral light emission according to claim 9, wherein the electronic components further comprise a micro-controller unit, the micro-controller unit comprises a plurality of input pins, a VDD pin, and a VSS pin;

the RGBW LED chip comprises four LED lamps, the positive electrodes of the four LED lamps are respectively connected to the second end of the second resistor;

the first resistor is connected with a first capacitor in parallel, the second end of the second resistor and the fourth terminal are respectively connected with a second capacitor and a voltage-regulator diode in parallel;

the negative electrodes of the four LED lamps are respectively connected to the input pins, the VDD pin is connected to the second end of the second resistor, and the VSS pin is connected to the fourth terminal and grounded.

11. An LED device with lateral light emission, comprising: a circuit board, electronic components, and an LED light source, Wherein the circuit board comprises a substrate, a top conductive layer, a bottom conductive layer, and power source leads, the substrate has multiple surfaces including a top surface, a bottom surface, and a plurality of side surfaces, the top conductive layer and bottom conductive layer are respectively provided on the upper side and the bottom side of the substrate and each include a conductive pattern that connects the electronic components thereon, the power source leads are connected to the top conductive layer or the bottom conductive layer;

the electronic components respectively arranged on the upper side and the bottom side of the substrate are electrically connected by conductive holes provided on the substrate;

the LED light source comprises a plurality of LED chips respectively provided on one or more of the multiple surfaces of the substrate;

the conductive holes include a plurality of via holes correspondingly located on the side surfaces of the substrate provided with the LED chips, each via hole has a side opening, and a sidewall of each via hole is coated with a conductive layer;

the LED chips each include a light-emitting surface and pins located on an opposite side of the light-emitting surface, the pins of the LED chip(s) located on the side surface(s) of the substrate pass(es) through the side openings of the via holes to be electrically connected with the conductive layers on the sidewalls of the via holes.

12. The LED device with lateral light emission according to claim 11, wherein the conductive layer is coated on the sidewall of each via hole by electroless plating, and the pins of the LED chip(s) are electrically connected with the conductive layers via a solder.

13. The LED device with lateral light emission according to claim 9, wherein the electronic components comprise a bridge rectifier, a first resistor, and a second resistor;

the bridge rectifier comprises a first terminal, a second terminal, a third terminal, and a fourth terminal;

the power source leads comprise a positive lead and a negative lead;

the positive lead is connected to a first end of the first resistor, a second end of the first resistor is connected to the first terminal, the second terminal is connected to a first end of the second resistor, a second end of the second resistor is connected to a positive electrode of the LED light source, a negative electrode of the LED light source is connected to the fourth terminal, and the third terminal is connected to the negative lead.

14. The LED device with lateral light emission according to claim 13, wherein the LED light source is a monochrome LED chip.

15. The LED device with lateral light emission according to claim 13, wherein the LED chips are RGB LED chips, the substrate further comprises a middle layer located between the top conductive layer and the bottom conductive layer, the conductive holes further include one or more buried via holes provided on the the middle layer, and the via holes are only provided on the side surfaces of the top conductive layer and the bottom conductive layer.

16. The LED device with lateral light emission according to claim 15, wherein the electronic components further comprise a micro-controller unit, the micro-controller unit comprises a plurality of input pins, a VDD pin, and a VSS pin;

the RGB LED chips are connected in parallel, and each RGB LED chip comprises three LED lamps, the positive electrodes of the three LED lamps are respectively connected to the second end of the second resistor;

the first resistor is connected with a first capacitor in parallel, the second end of the second resistor and the fourth terminal are respectively connected with a second capacitor and a voltage-regulator diode in parallel;

the negative electrodes of the three LED lamps are respectively connected to the input pins, the VDD pin is connected to the second end of the second resistor, and the VSS pin is connected to the fourth terminal and grounded.

17. The LED device with lateral light emission according to claim 13, wherein the LED chips are RGBW LED chips, the substrate further comprises a first middle layer, a second middle layer, and a third middle layer sequentially located between the top conductive layer and the bottom conductive layer, the conductive holes further include one or more buried via holes provided on the first middle layer and third middle layer, and the via holes are only provided on the side surfaces of the top conductive layer, the bottom conductive layer, and the second middle layer.

18. The LED device with lateral light emission according to claim 17, wherein the electronic components further comprise a micro-controller unit, the micro-controller unit comprises a plurality of input pins, a VDD pin, and a VSS pin;

the RGBW LED chips are connected in parallel, and each RGBW LED chip comprises four LED lamps, the positive electrodes of the four LED lamps are respectively connected to the second end of the second resistor;

the first resistor is connected with a first capacitor in parallel, the second end of the second resistor and the fourth terminal are respectively connected with a second capacitor and a voltage-regulator diode in parallel;

the negative electrodes of the four LED lamps are respectively connected to the input pins, the VDD pin is connected to the second end of the second resistor, and the VSS pin is connected to the fourth terminal and grounded.

* * * * *